US008863457B2

(12) United States Patent
Rottiers et al.

(10) Patent No.: US 8,863,457 B2
(45) Date of Patent: Oct. 21, 2014

(54) CONSTRUCTION ELEMENT FOR USE IN INTERIOR DECORATION

(75) Inventors: Alex Rottiers, Lichtaart (BE); Tom Weyers, Grobbendonk (BE); Stephan Mees, Berchem (BE)

(73) Assignee: Under-Cover, Herentals (BE)

( * ) Notice: Subject to any disclaimer, the term of this patent is extended or adjusted under 35 U.S.C. 154(b) by 883 days.

(21) Appl. No.: 12/306,481

(22) PCT Filed: Jun. 25, 2007

(86) PCT No.: PCT/EP2007/056327

§ 371 (c)(1),
(2), (4) Date: Apr. 2, 2009

(87) PCT Pub. No.: WO2008/000723

PCT Pub. Date: Jan. 3, 2008

(65) Prior Publication Data

US 2009/0277100 A1 Nov. 12, 2009

(30) Foreign Application Priority Data

Jun. 28, 2006 (EP) ..... 06116250

(51) Int. Cl.

| | |
|---|---|
| ***E04F 13/04*** | (2006.01) |
| ***E04F 13/06*** | (2006.01) |
| ***E06B 1/24*** | (2006.01) |
| ***A47H 1/104*** | (2006.01) |
| *F21V 33/00* | (2006.01) |
| *E04F 19/02* | (2006.01) |

(52) U.S. Cl.

CPC ..... *E04F 13/06* (2013.01); *E04F 2013/063* (2013.01); *A47H 1/104* (2013.01); *F21V 33/006* (2013.01); *E04F 13/04* (2013.01); *E04F 19/02* (2013.01); *E06B 1/24* (2013.01)

USPC ..... 52/366; 52/254; 52/255; 52/309.16; 362/147; 362/148

(58) Field of Classification Search

USPC ..... 52/254, 255, 256, 307.7, 309.16, 364, 52/366, 28, 417; 428/122; 362/145, 147, 362/148, 150, 154, 362, 368, 370

See application file for complete search history.

(56) References Cited

U.S. PATENT DOCUMENTS 125,844 A * 4/1872 Rice ..... 52/255
1,097,935 A * 5/1914 Pride ..... 52/255

(Continued)

FOREIGN PATENT DOCUMENTS

CH 112163 10/1925
CH 392 025 A 5/1965

(Continued)

OTHER PUBLICATIONS

European Search Report for EP2090713 A3; Feb. 2, 2010.

(Continued)

*Primary Examiner* — Robert Canfield
*Assistant Examiner* — Charissa Ahmad
(74) *Attorney, Agent, or Firm* — Sughrue Mion, PLLC

(57) ABSTRACT

The invention relates to a construction element (1) for use in interior decoration of a building construction (5), comprising a body (2) having a functional, non planar shape by which the construction element is adapted for fulfilling an additional function with respect to wall plastering (6) and which is provided to remain uncovered by wall plastering. The construction element (1) comprises joining elements (4) at one or more peripheral edges (3) of the body (2), adapted for being covered with wall plastering (6) which is applied around the peripheral edges (3) for covering part of the building construction (5). The body (2) and the joining elements (4) are constructed in a reinforced wall plastering material.

16 Claims, 4 Drawing Sheets

(56) References Cited

U.S. PATENT DOCUMENTS

| | | | | | |
|---|---|---|---|---|---|
| 1,098,792 | A | * | 6/1914 | Ficklen | 404/69 |
| 1,383,249 | A | * | 6/1921 | Utzman | 52/591.4 |
| 1,500,359 | A | | 7/1924 | Auld | |
| 1,508,658 | A | * | 9/1924 | Jenkins | 428/122 |
| 1,555,555 | A | * | 9/1925 | Comerma | 428/124 |
| 1,582,721 | A | * | 4/1926 | Adams | 52/417 |
| 1,642,282 | A | * | 9/1927 | Weiss | 52/417 |
| 1,657,332 | A | * | 1/1928 | Absmeier | 52/417 |
| 1,685,254 | A | * | 9/1928 | Walper | 52/363 |
| 1,801,400 | A | * | 4/1931 | Venzie | 52/289 |
| 1,910,554 | A | * | 5/1933 | Loehr et al. | 52/717.06 |
| 2,064,704 | A | * | 12/1936 | Vass | 52/85 |
| 2,114,044 | A | * | 4/1938 | Bonnell | 52/288.1 |
| 2,196,086 | A | * | 4/1940 | Sprouse et al. | 52/255 |
| 2,218,731 | A | * | 10/1940 | Harris et al. | 362/309 |
| 2,272,162 | A | * | 2/1942 | Lackey | 52/344 |
| 2,301,187 | A | * | 11/1942 | Balhatchet | 52/105 |
| 2,314,523 | A | * | 3/1943 | Speer | 52/417 |
| 2,765,884 | A | * | 10/1956 | Steffan et al. | 52/211 |
| 2,796,641 | A | * | 6/1957 | Wollaeger | 52/255 |
| 3,201,910 | A | * | 8/1965 | Keesee | 52/287.1 |
| 3,255,561 | A | * | 6/1966 | Cable | 52/255 |
| 3,350,257 | A | * | 10/1967 | Hourigan et al. | 428/70 |
| 3,385,019 | A | * | 5/1968 | Frank | 52/417 |
| 3,391,509 | A | * | 7/1968 | Fruman | 52/367 |
| 3,398,494 | A | * | 8/1968 | Larson | 52/371 |
| 3,465,488 | A | * | 9/1969 | Miller | 52/481.1 |
| 3,712,003 | A | * | 1/1973 | Hallock et al. | 52/254 |
| 3,922,828 | A | * | 12/1975 | Patton | 52/368 |
| 4,005,558 | A | * | 2/1977 | Barrison | 52/213 |
| 4,076,884 | A | * | 2/1978 | Riley et al. | 442/3 |
| 4,187,275 | A | * | 2/1980 | Bracalielly et al. | 264/511 |
| 4,233,790 | A | * | 11/1980 | Meadows | 52/222 |
| 4,443,261 | A | * | 4/1984 | Nordqvist | 106/772 |
| 4,545,162 | A | * | 10/1985 | Attaway | 52/255 |
| 4,584,224 | A | * | 4/1986 | Schneller | 428/60 |
| 4,693,924 | A | * | 9/1987 | Kuper et al. | 428/170 |
| 4,722,153 | A | * | 2/1988 | Hardy | 52/255 |
| 4,825,612 | A | * | 5/1989 | Tupman | 52/371 |
| 4,862,332 | A | * | 8/1989 | Hardy | 362/145 |
| 5,477,643 | A | * | 12/1995 | Koenig, Jr. | 52/100 |
| 5,544,463 | A | * | 8/1996 | Bergin | 52/254 |
| 5,625,986 | A | * | 5/1997 | Mansfield et al. | 52/255 |
| 5,671,583 | A | * | 9/1997 | Turner | 52/745.16 |
| 5,740,642 | A | * | 4/1998 | Koenig et al. | 52/255 |
| 5,752,353 | A | * | 5/1998 | Koenig et al. | 52/255 |
| 5,761,866 | A | * | 6/1998 | Maylon | 52/366 |
| 5,799,458 | A | * | 9/1998 | Ferguson | 52/417 |
| 5,904,016 | A | * | 5/1999 | Koenig et al. | 52/255 |
| 5,921,655 | A | * | 7/1999 | Nassim | 362/147 |
| 5,979,129 | A | * | 11/1999 | Azar | 52/211 |
| 6,105,334 | A | * | 8/2000 | Monson et al. | 52/741.3 |
| 6,217,189 | B1 | * | 4/2001 | Nassim | 362/147 |
| 6,228,507 | B1 | * | 5/2001 | Hahn | 428/542.2 |
| 6,338,229 | B1 | * | 1/2002 | Botzen | 52/371 |
| D456,528 | S | * | 4/2002 | Maylon et al. | D25/121 |
| 6,453,631 | B1 | * | 9/2002 | Headrick | 52/210 |
| 6,779,313 | B2 | * | 8/2004 | Smythe, Jr. | 52/255 |
| 6,838,618 | B2 | * | 1/2005 | Newbold et al. | 174/50 |
| 6,997,574 | B2 | * | 2/2006 | Kotovsky | 362/147 |
| 7,338,702 | B2 | * | 3/2008 | Swales et al. | 428/294.1 |
| 7,651,238 | B2 | * | 1/2010 | O'Brien | 362/148 |
| 8,141,316 | B2 | * | 3/2012 | Remin | 52/631 |
| 8,257,526 | B2 | * | 9/2012 | Thompson et al. | 156/71 |
| 2002/0035809 | A1 | * | 3/2002 | Smythe, Jr. | 52/255 |
| 2002/0134901 | A1 | | 9/2002 | Chadwick | |
| 2003/0019164 | A1 | | 1/2003 | Weakes et al. | |
| 2003/0086258 | A1 | * | 5/2003 | Kotovsky | 362/147 |
| 2003/0086259 | A1 | * | 5/2003 | Kotovsky | 362/147 |
| 2004/0045239 | A1 | * | 3/2004 | Milu | 52/311.1 |
| 2004/0055245 | A1 | * | 3/2004 | Fitch | 52/716.8 |
| 2004/0090772 | A1 | * | 5/2004 | Newbold et al. | 362/147 |
| 2005/0257461 | A1 | * | 11/2005 | Daly | 52/254 |
| 2006/0191529 | A1 | * | 8/2006 | McDonald | 126/500 |
| 2007/0107336 | A1 | * | 5/2007 | Conboy | 52/255 |
| 2009/0038250 | A1 | * | 2/2009 | Frenkil | 52/447 |
| 2009/0315437 | A1 | * | 12/2009 | Lee | 312/326 |
| 2010/0192494 | A1 | * | 8/2010 | Baccarini | 52/287.1 |
| 2010/0238670 | A1 | * | 9/2010 | Moench | 362/365 |

FOREIGN PATENT DOCUMENTS

| | | | | | |
|---|---|---|---|---|---|
| DE | 3029805 | A1 | | 2/1982 | |
| DE | 19525560 | A1 | | 1/1996 | |
| DE | 19841294 | A1 | | 9/1999 | |
| DE | 201 04 657 | U1 | | 6/2001 | |
| DE | 20104657 | U1 | | 6/2001 | |
| EP | 0699866 | A1 | | 3/1996 | |
| EP | 0 957 309 | A2 | | 11/1999 | |
| EP | 1553242 | A1 | | 7/2005 | |
| FR | 2683616 | A1 | * | 5/1993 | F21S 1/02 |
| GB | 629980 | | | 10/1949 | |
| GB | 2285470 | A | | 7/1995 | |
| JP | 5028088 | Y | | 8/1975 | |
| JP | 54104024 | A | * | 8/1979 | E04D 13/06 |
| JP | 54104026 | A | * | 8/1979 | E04D 13/08 |
| JP | 246574 | Y | | 12/1990 | |
| JP | 318309 | U | | 2/1991 | |
| JP | 2006151714 | A | | 6/2006 | |
| WO | WO 0012840 | A1 | * | 3/2000 | |
| WO | WO 2008043483 | A1 | * | 4/2008 | F21V 21/04 |

OTHER PUBLICATIONS

European Search Report for EP 2093345 A3; Feb. 8, 2010.
European Search Report for EP 2093346 A3; Feb. 5, 2010.
European Search Report EP 2 093 347 A3; Feb. 9, 2010.
Chinese Office Action 2009-517157; Aug. 29, 2012, English translation.

* cited by examiner

CONSTRUCTION ELEMENT FOR USE IN INTERIOR DECORATION

CROSS REFERENCE TO RELATED APPLICATION

This application is a National Stage of International Application No. PCT/EP2007/056327 filed Jun. 25, 2007, claiming priority based on European Patent Application No. 06116250.9, filed Jun. 28, 2006, the contents of all of which are incorporated herein by reference in their entirety.

The present invention relates to a construction element for use in interior decoration, according to the preamble of the first claim.

It is known that after a structure of a building is completed, the walls, ceilings and other building constructions or parts of building constructions of the building can be finished by covering them with plaster so that a smooth surface is obtained for painting, wallpapering or other types of finishing known to the person skilled in the art.

After plastering of the walls and ceilings, different construction elements can be mounted to the walls, ceilings and other building constructions to further finish the building. The construction elements comprise for example door jambs, light boxes or decorative elements which are hung to obtain the desired aesthetic effect. These construction elements are for example made of wood, plastic, aluminium or any other material found suitable for the person skilled in the art.

In modern architecture it is often desired that construction elements are seamlessly and invisibly incorporated into the plaster covering of the walls and ceilings. For example, seamless and invisible integration of door jambs into the plastering of a wall is often sought after to give a building a "minimalist" and modern design. Seamless integration of construction elements is also demanded in environments where high demands on hygiene are dictated such as for example kitchens or hospital rooms like operating rooms.

Thereto, construction elements are mounted to, for example, the walls before the plastering is applied, after which the construction elements may be partially or fully covered with plastering to obtain the seamless connection between the construction element and the plaster. However this way of interior decorating has the disadvantage that after a relative short period of time the connection between the construction element and the plaster may be broken thus creating cracks, splits and apertures between the construction element and the plaster covering.

Accordingly, it is the object of the present invention to provide construction elements which can be seamlessly integrated with the plaster covering.

This is achieved according to the present invention with a construction element showing all the technical features of the first claim.

Thereto, the construction element comprises joining elements at one or more peripheral edges of the body, adapted for being covered with wall plastering, the body and the joining elements being constructed in a reinforced wall plastering material.

An analysis of the problem of the prior art has shown that the cracks, splits and apertures are caused by different material properties of construction elements and wall plastering. According to the invention, the body and the joining elements are constructed in a reinforced wall plastering material so that the wall plaster and the joining elements mainly comprise the same substances. As a result, the wall plastering of the building construction is better bonded with the reinforced wall plaster of the construction element. The bond between the wall plaster and the reinforced wall plaster is also not easily broken since both materials mainly comprise the same substances and react in substantially the same way to temperature variations, humidity etc. As a result, the risk that cracks, splits and/or apertures will appear after a period of time can be substantially reduced. The construction element can therefore be seamlessly integrated with the plaster covering, creating the desired aesthetic effect.

The inventor has further found that the use of reinforced wall plastering material for the construction element according to the invention provides the construction element with the desired strength and rigidity and moreover improves the impact-resistant capacity of the construction element. The construction element according to the invention can therefore be applied in a wide range of applications.

Since a reinforced wall plastering material is being used for the construction element, the inventor has further found that the construction element can be easily produced and processed. The construction element according to the invention can for example be moulded. This makes the production of the construction elements less difficult, faster, more reproducible and therefore less expensive. In addition to the ease of production and processing of the construction element, the use of reinforced wall plastering material allows a broad range of shapes, dimensions and therefore applications of the construction element.

The inventor moreover has found that construction elements constructed in a reinforced wall plastering material are light and maneuverable, rendering them easy to transport and install.

The inventor has further found that the reinforced wall plaster material has fire resisting properties, which renders it suitable for use in constructions having specific demands on the fire-safety of the construction materials.

In a preferred embodiment of this invention the reinforced wall plastering material is glass reinforced gypsum (GRG). GRG is a reinforced wall plastering material which is very mouldable, easy to make, cheap, has increased strength, rigidity and impact-resistant capacities. GRG moreover shows increased bonding capacities with the wall plastering.

In a more preferred embodiment of the construction element according to the invention the joining element is wedge-shaped with a maximal thickness at the peripheral edge of the body, the maximal thickness being less than that of a wall plaster layer. The wedge-shaped joining element allows for an easy, fast and sturdy creation of a seamless integration of the construction element with the plaster covering.

In a further more preferred embodiment of the construction element according to the invention the construction element comprises at least one reinforcing element embedded in the reinforced wall plastering material. The reinforcing element reinforces the overall strength and rigidity of the construction element. Additionally the reinforcing piece can reinforce a connection of the construction element to the building construction. In another further preferred embodiment, the reinforcing element is embedded in the reinforced wall plastering material of the joining element.

In a preferred embodiment of the invention the body of the construction element comprises a receiver for a secondary element. The secondary element can comprise any one of the following: a hinge, a receiver for a bolt of a door, a bracket for mounting a lamp, a lightsource, a loudspeaker, a curtain rail, openings for air supply and/or air extraction, a sprinkler, a smoke detector but is not restricted thereto. The construction element can therefore serve different purposes making it versatile in use next to its versatility in form and shape while maintaining its aesthetic design and modern look.

In a more preferred embodiment of the invention, the reinforcing element reinforces the receiver for the secondary element rendering the mounting of the secondary element sturdier and more durable.

In a first preferred embodiment of the invention the body of the construction element comprises at least one door jamb. The door jamb can be invisibly connected with the wall, creating an invisible integration of the door jamb with the rest of the wall, adding to the minimalist and modern design of the interior which is often sought after in modern architecture.

In a second preferred embodiment of the invention the body of the construction element comprises a light box. The light box can be invisibly connected with the wall or the ceiling, for example creating an invisible integration of the light box with the rest of the wall or the ceiling, further adding to the minimalist and modern design of the interior.

The invention will be further elucidated by means of the following description and the appended figures.

Figure 1:
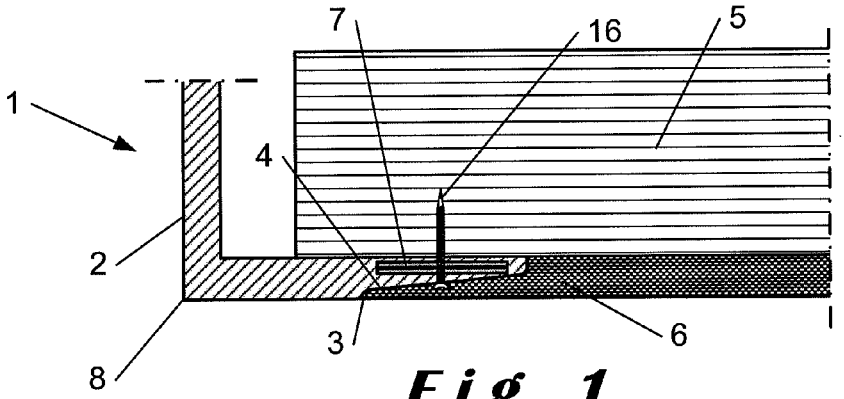
FIG. 1 shows a cross-section of a construction element according to the invention mounted to a wall.

The construction element 1 of FIG. 1 is used in interior decoration of a building. It is mounted to a wall 5 by a screw 16 driven through the joining element 4 and comprises a body 2 and joining elements 4 at a peripheral edge 3 of the body 2. The body 2 and the joining elements 4 are constructed in reinforced wall plastering material. The joining element 4 is covered by wall plastering 6, which at least partly covers the wall 5.

The reinforced wall plastering material preferably is reinforced gypsum, more preferably glass reinforced gypsum (GRG) but can be any material deemed appropriate by the person skilled in the art such as for example wood fibre reinforced gypsum. Since reinforced wall plastering material and glass reinforced gypsum in particular is strong, light, impact-resistant, compliant with fire regulations, cheap, fast and easy to fabricate and treat, the construction element 1 can have any shape and function deemed appropriate by the person skilled in the art. Additionally, reinforced wall plastering materials are mouldable so that the desired shape of the construction element 1 can easily be reproduced without negatively affecting the other characteristics. Moreover, the easy treatment of the reinforced wall plastering makes the installation of the construction element 1 to the wall 5 easier, faster and cheaper.

The joining elements 4 are adapted to be covered with the wall plastering 6. Since both the construction element 1 and the wall plastering 6 comprise plaster as a substantial part of their composition, the construction element 1 and the wall plastering 6 can be better bonded to each other. The bond between the wall plastering 6 and the reinforced wall plaster is also not easily broken since both materials mainly comprise the same substances and react in substantially the same way to temperature variations, humidity etc. As a result, the risk that cracks, splits and/or apertures will appear after a period of time can be substantially reduced. The construction element 1 can therefore be seamlessly integrated with the plaster covering, creating the desired aesthetic effect.

The joining element 4 can be provided along the entire length of the peripheral edge 3 of the body 2 of the construction element 1 or for example only distinct locations of the peripheral edge 3 of the construction element 1 can be provided with joining elements 4 depending for example on the desired aesthetical and/or physical characteristics of the construction element 1.

The shape of the joining element 4 and the shape of the transition of the peripheral edge 3 to the joining element 4 of the construction element 1 of FIG. 1 are such that a continuous and seamless transition from the wall plastering 6 to the body 2 is created when wall plastering 6 abuts to the body 2 at the peripheral edge 3. Hereto, the joining elements 4 are wedge-shaped with a maximal thickness at the peripheral edge 3 of the body 2, the maximal thickness being less than that of a layer of wall plastering 6. However, the joining element 4 can have any other shape deemed appropriate by the person skilled in the art such as for example: parallel to the surface of the wall 5 to which it is mounted in stead of wedge-shaped, the maximal thickness at the peripheral edge 3 of the body 2 can be more than that of a layer of wall plastering 6 or other shapes.

In the embodiment of FIG. 1, the thickness of the joining element 4 continuously decreases away from the peripheral edge 3. The progression of the decrease of the thickness of the joining element 4 is however not critical to the invention and can be determined by the person skilled in the art and is for example linear or exponential since such a shape allows an easy and fast covering of the joining element 4 with wall plastering 6. The progression of the decrease can however have a local minimum and/or local maximum in thickness between the peripheral edge 3 and an edge of the joining element 4 or the thickness can for example undulate from the peripheral edge 3 towards an edge of the joining element 4.

To achieve proper finishing of the construction element 1, preferably sufficient wall plastering 6 is added on the wedge-shaped joining element 4 so that part of the wall plastering 6 partly overlaps the body 2 of the construction element 1. Preferably, the overlapping and superfluous wall plastering 6 is then removed by dragging a straight edge over the surface of the body 2, leaving a seamless and continuous connection between the wall plastering 6 and the body 2 of the construction element 1.

The method for applying the wall plastering 6 to the construction element 1 is however not critical to the invention and any other method deemed appropriate to the person skilled in the art to make a seamless connection between the construction element 1 and the wall plastering 6 may be used.

The joining element 4 according to FIG. 1 is fully covered with wall plastering 6 which allows for a strong bond between the wall plastering 6 and the joining element 4 and a continuous and seamless integration of the wall plastering 6 with the body 2. Fully covering the joining element 4 with wall plastering 6 is however not critical for the invention. The joining element 4 can also be partially covered with wall plastering 6 according to, for example, the envisioned aesthetic effect of the person skilled in the art.

In FIG. 1, the construction element 1 comprises reinforcing elements 7 embedded in the reinforced plastering material of the joining element 4. Alternatively, reinforcing elements (not shown) may also be applied in the body 2 or throughout the construction element 1. The location of the reinforcing element in the body 2 of the construction element 1 for example depends on whether a screw 16 is driven through the construction element 1 at that location to reinforce the mounting of the screw 16 as for example shown in FIG. 1 and on the on the desired physical characteristics of the construction element 1 as for example strength, rigidity, impact-resistance, sound-proofing properties, thermal properties. . . The function of the reinforcing element is however not limited to these examples and is not critical to the invention.

The dimensions of the reinforcing element depend for example on the desired physical characteristics of the construction element 1, as considered previously, and on the shape, form and dimensions of the construction element 1 limiting the dimensions of the reinforcing element 7 when at least partially embedding the reinforcing element 7 in the construction element 1.

The cross-section of the reinforcing element 7 shown in FIG. 1 is rectangular but can have any shape deemed appropriate to the person skilled in the art, such as for example: circular, ellipsoid, square,. . . The integral reinforcing element 7 preferably is cuboid but for example can also be spherical.

The material of the reinforcing element 7 depends on the desired physical characteristics of the reinforcing element 7 previously considered and can be for example: wood, metal, cardboard,. . .

Instead of driving the screw 16 through the joining element 4, as shown in FIG. 1, to connect the construction element 1 to the wall 5, the screw 16 can also be driven through the body 2 of the construction element 1. The location for screwing can be determined by the person skilled in the art and depends amongst other things on the requirements for mounting the construction element 1 to the wall 5, the mounting location, the desired aesthetical effect, the location of the reinforcing element. . .

The screw 16 in FIG. 1 is made invisible for a spectator looking at the construction element 1. Thereto the screw 16 is covered with wall plastering 6 covering the joining element 4. When the screw 16 is driven through the body 2, the body 2 can for example comprise a recess in its surface in order to provide a screwing location which can be covered with wall plastering 6 after screwing in order to conceal the screw 16. Covering of the screws 16 is however not critical to the invention and is merely an aesthetical choice which can be made by the person skilled in the art.

The screw 16 used for connecting the construction element 1 to the wall 5 is not critical for the invention and alternatively the construction element 1 could also be connected by for example gluing, stapling, nailing or any other way known to the person skilled in the art.

The construction element 1 shown in FIG. 1 is mounted to a wall 5 but can also be mounted to a ceiling, drywall, another construction element 1 according to the invention,. . .

The body 2 has a functional, non planar shape and is adapted for fulfilling an additional function with respect to wall plastering 6. In FIG. 1, the body 2 creates a corner section 8 and therefore fulfils an additional function with respect to wall plastering.

The corner section 8 shown in FIG. 1 delimits a perpendicular angle. However, any other corner section (not shown) may be used, for example a corner section comprising a different angle, a curved corner section,. . .

Figure 2:
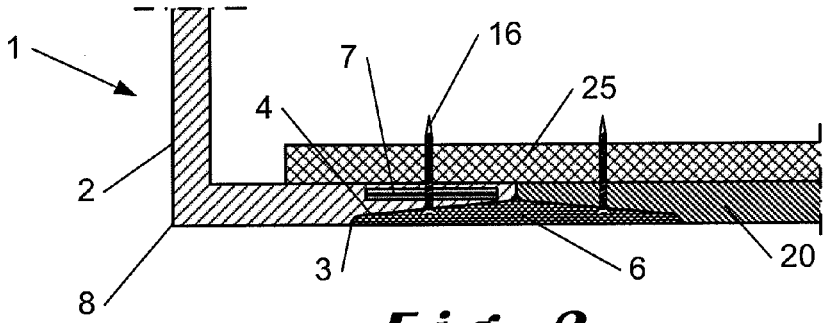
FIG. 2 shows a cross-section of another construction element according to the invention mounted to a wall.

The construction element 1 shown in FIG. 2 is the same as the construction element 1 shown in FIG. 1 but is mounted to a thinner wall 25, which can for example be a wooden panel, and abuts to another element 20 which also covers the wall 25. The other element shown in FIG. 2 is partially covered with wall plastering 6 and can for example be a dry wall, or another construction element according to the invention, which can be identical to the construction element 1 or can for example serve a different purpose and therefore have a different shape and function, or any other element that can be used in construction for example for decorating the interior.

Figure 3:
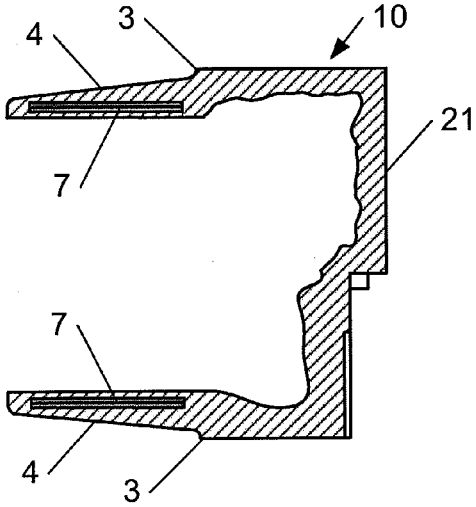
FIG. 3 shows a cross-section of another construction element according to the invention comprising a door jamb.

The construction element 10 shown in FIG. 3 differs from the construction element 1 shown in FIG. 1 in that the body 21 of the construction element comprises a door jamb 10 and in that the construction element 10 comprises, in cross-sectional view, a joining element 4 at both peripheral edges 3 of the body 21. The body 21 is shaped for enclosing a wall part (not shown) adjacent to a door opening, to which end the joining elements 4 are provided on both sides of the body 21 so that wall plastering can be applied on both sides of the door opening to seamlessly integrate the door jamb 10 with wall plastering (not shown) covering the wall part.

The body 21 shown in FIG. 3 only comprises a door jamb 10 but more elements having a functional non planar shape can be embedded in the body 21 of the construction element 1, for example a corner section covering a corner of the wall adjacent to the door opening.

The door jamb 10 shown in FIG. 3 is made out of one construction element 10 but can comprise several construction elements which can be seamlessly connected to each other by covering the abutting edges of the constituent construction elements with wall plastering 6 for example as shown in FIG. 2.

The body 21 of the door jamb 10 shown in FIG. 3 is entirely delimited by joining elements 4 which allow a seamless connection of the door jamb 10 with the wall plastering 6 at least partially covering the joining elements 4 at both sides of the doorway. The door jamb 10 can however provide only a joining element 4 at one side of the doorway depending on the desired aesthetical properties of the construction element 1 on the different sides of the doorway.

The door jamb 10 shown in FIG. 3 only comprises reinforcing elements 7 in the joining elements 4. The door jamb 10 can however comprise additional or less reinforcing elements 7 in the joining elements 4 and/or the body 2 more specifically in the door jamb 10 to provide the joining elements 4 and/or body 2, more specifically the door jamb 10, with the desired physical characteristics as discussed earlier on.

The exact dimensions and shape of the door jamb 10 can be determined by the person skilled in the art and are not critical to the invention.

The door jamb 10 can further comprise, although not shown in FIG. 3, hinges for mounting a door to the door jamb 10. At the location of the hinges, the door can be reinforced by further reinforcing elements (not shown) to give the door jamb 10 its desired physical characteristics as previously discussed.

Figure 4:
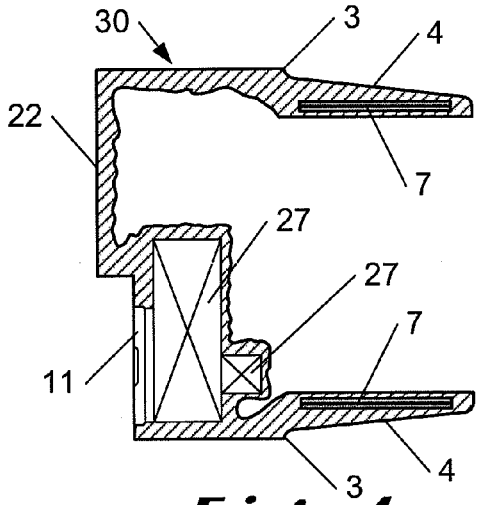
FIG. 4 shows a cross-section of another construction element according to the invention comprising a door jamb comprising a receiver for a bolt of a door which is reinforced by a reinforcing element.

The door jamb 30 shown in FIG. 4 differs from the door jamb 10 shown in FIG. 3 in that the body 22 comprises a receiver 11 for receiving a bolt of a lock of a door. The receiver 11 for the bolt of a lock of a door is reinforced additionally by a reinforcing elements 27 embedded in the door jamb 30.

The location, shape and dimensions of the receiver for the lock of the door can be determined by the person skilled in the art and is not critical to the invention.

The reinforcing means 27 reinforcing the receiver 11 for the bolt of the lock can be omitted depending on the desired physical characteristics of the door jamb 30, door and/or doorway.

Figure 5:
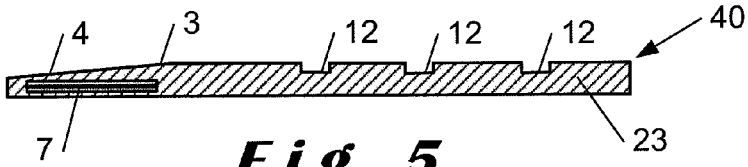
FIG. 5 shows a cross-section of another construction element according to the invention which comprises receivers for receiving secondary elements.

The construction element 40 shown in FIG. 5 comprises three receivers 12 for secondary elements (not shown) as an additional function with respect to wall plastering. The body 23 of the shown construction element 1 is essentially flat but can have any desired shape such as for example cuboid or curved, since the reinforced plastering material is very mouldable. The receivers 12 shown in FIG. 5 can be used for mounting for example curtain rails, rails for mounting spotlights or other elements or any other secondary element (not shown).

The shape and form of the receiver 12 is not critical to the invention and for example depends on the shape, form, dimensions and function of the secondary element.

Three receivers 12 are shown in FIG. 5, however less or more receivers 12 are possible. The receivers 12 for the secondary elements can be mainly longitudinally and straight, can be circular, curved or can have any other form and shape depending on the desired function, shape, form and dimensions of the receiver 12 and the secondary elements received in it.

The receivers 12 in this embodiment are provided in the body of the construction element 40 as recessions in the surface of the body 23. Alternatively, any other way of creating the receiver 12 is possible, for example by locally elevating the surface of the body 23 at the receiver 12.

The construction element 40 shown in FIG. 5 only comprises a reinforcing element 7 embedded in the joining element 4. Alternatively, additional or less reinforcing elements 7 can be provided in the construction element 40 as discussed previously. For example, reinforcing elements (not shown) can be provided at the receivers 12 for the secondary elements so that the connection of the secondary elements to the construction element 40 can be reinforced according to the desired physical characteristics of the construction element 40 and for example the shape, form, dimensions and weight of the secondary element.

The construction element 40 shown in FIG. 5 comprises just one joining element 4 at one peripheral edge 3 of the body 2. The construction element 1 can however comprise additional joining elements (not shown) at the opposite peripheral edge or other peripheral edges 3 not shown in FIG. 5 which are not provided with a joining element 4, similar to the construction element 1 shown in FIG. 1.

Figure 6:
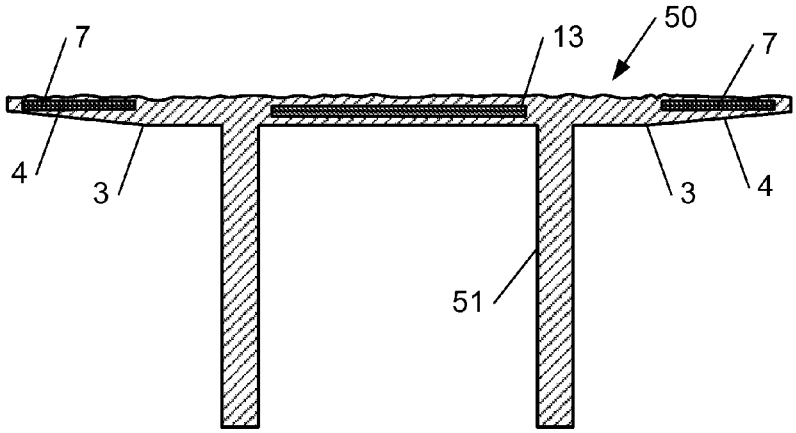
FIG. 6 shows a cross-section of another construction element according to the invention which comprises a reinforcing element for mounting secondary elements.

The construction element 50 shown in FIG. 6 is a light box and comprises a box-shaped body 51 with sideways extending joining elements 4 at both visible peripheral edges 3 in the shown cross-section. Again, reinforcing elements 7 are embedded in the joining elements 4.

The construction element 50 of FIG. 6 comprises a reinforcing element 13 which is embedded in the body 51 and which acts as a receiver for secondary elements such as a bracket 113 for mounting a lamp, lamps, spotlights or other lightsources, openings for air supply and/or air extraction, sprinklers, loudspeakers, smoke detectors or any other element deemed appropriate by the person skilled in the art. The secondary elements can be mounted to the construction element 50 by for example providing a hole for receiving the secondary element or by fixing the secondary element to the body 51 by screwing, gluing, nailing,. . .

The reinforcing element 13 embedded in the body 51 of the construction element 50, as shown in FIG. 6, can be omitted or additional reinforcing elements (not shown) can be provided depending on the desired physical characteristics of the construction element 50, according as to previously described.

The reinforcing element 13 has a shape, form, dimensions and physical properties depending on the shape, form, dimensions and weight of the secondary elements received by the reinforcing element 13.

The body 51 of the construction element 50 differs from the body 51 of construction elements 50 of previously depicted construction elements 50 in that the body 51 defines a volume between two longitudinal protrusions delimiting the receiver 13 for secondary elements.

The protrusions do not have to be longitudinal but can have any shape and form desired by the person skilled in the art depending on the function and desired shape, form and dimensions of the created volume, which for example can be used for receiving lightsources by creating a cuboid or organically curved light box by combining combinations of different protrusions, for receiving curtains and/curtain rails by creating a cuboid or organically curved box by combining combinations of different protrusions or for receiving any other application deemed appropriate.

The shape, form and dimensions of the volume which is created depends on the form, shape and dimensions of the secondary elements which have to be received in the volume and on the desired aesthetical effect of the construction element 50.

The construction element 50 alternatively can comprise only one protrusion or more than two protrusions to create the volume, possibly in combination with other existing constructions as for example walls, ceilings,. . .

The construction element 50 can also comprise a joining element 4 at just one peripheral edge 3 or at more than two peripheral edges 3, as previously discussed.

Figure 7:
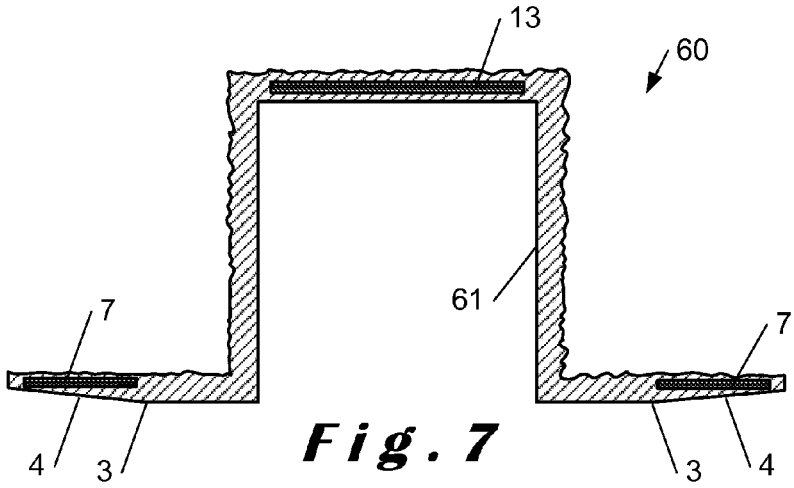
FIG. 7 shows a cross-section of a different embodiment of the construction element according to the invention as shown in FIG. 6.

The construction element 60 shown in FIG. 7 differs from the construction element 50 shown in FIG. 6 in that the volume created by the body 61 for receiving the secondary elements (not shown) does not protrude from the surface of the building construction (not shown) to which it is mounted. When mounting the construction element 60 of FIG. 7 to for example a wall (not shown) or ceiling (not shown), the volume created to receive the secondary elements can be integrated into the wall or the ceiling to which it is mounted.

The volume created for receiving the secondary elements can have any desired shape and can for example by cuboid, or organically curved depending on the desired aesthetical effect and the shape, form, dimensions and function of the secondary elements received in the volume.

Figure 8:
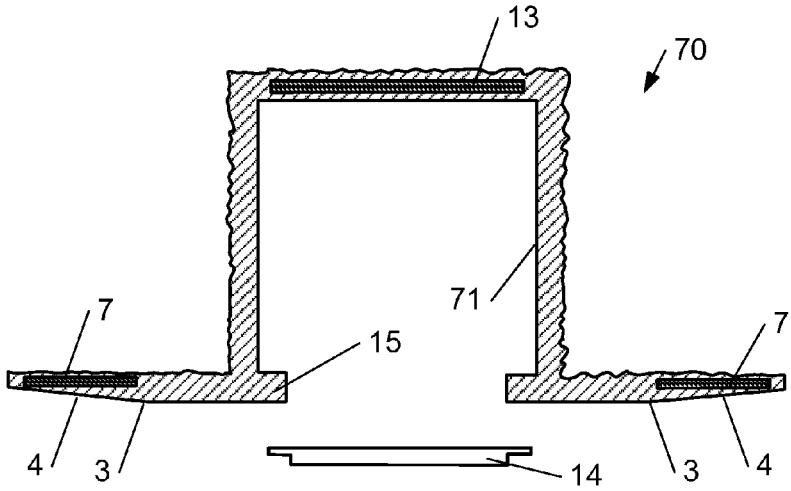
FIG. 8 shows a cross-section of a construction element according to the invention as shown in FIG. 7 and a lid for covering the construction element.

The construction element 70 shown in FIG. 8 differs from the construction element 60 shown in FIG. 7 in that the body 71 comprises a receiver 15 for a lid 14 so that the volume can at least partially be sealed. The lid 14 is for example made of glass or acrylic glass or any other material found suitable to a person skilled in the art.

Figure 9:
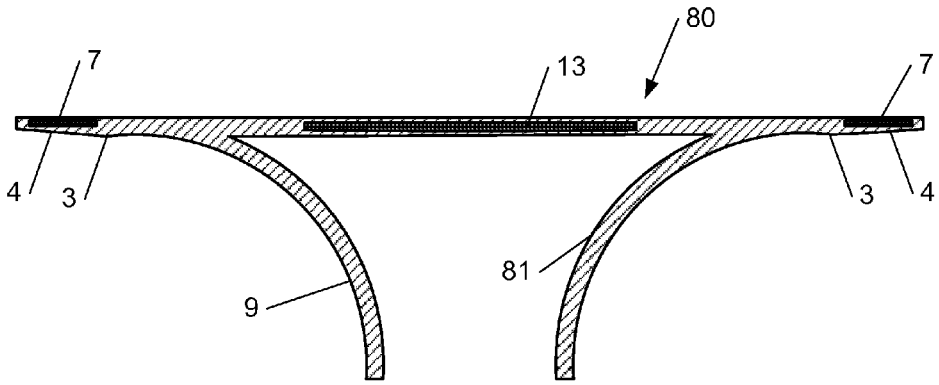
FIG. 9 shows a cross-section of a different embodiment of the construction element according to FIG. 6.

The construction element 80 shown in FIG. 9 differs from the construction element 50 shown in FIG. 6 in that the protrusions of the body 81 creating the volume for receiving the secondary elements (not shown) are curved, thus creating an organically curved surface 9 for a spectator looking at the construction element 1, which can be a desired aesthetical effect for use in interior decorating.

Figure 10:
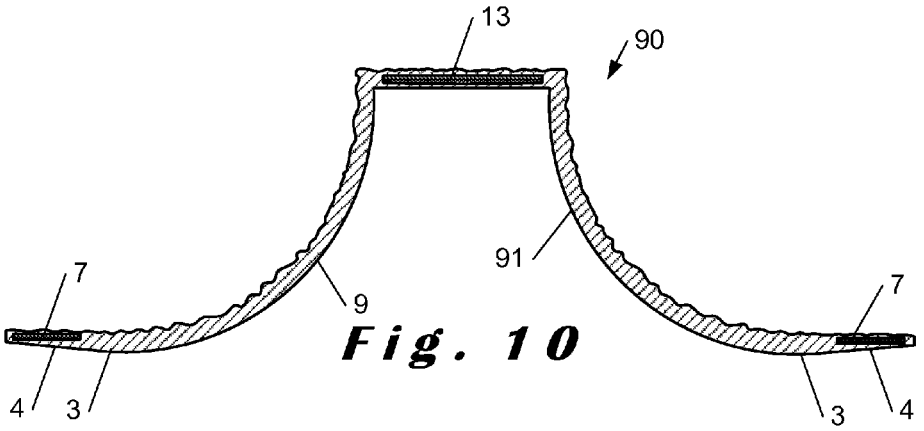
FIG. 10 shows a cross-section of a different embodiment of the construction element according to FIG. 7.

The construction element 90 shown in FIG. 10, differs from the construction element 60 shown in FIG. 7 in that the volume created by the body 91 for receiving secondary elements (not shown) comprises curved sidewalls 9 so that the volume is not cuboid but is curved, which can be a desired aesthetical effect in interior decoration.

Figure 11:
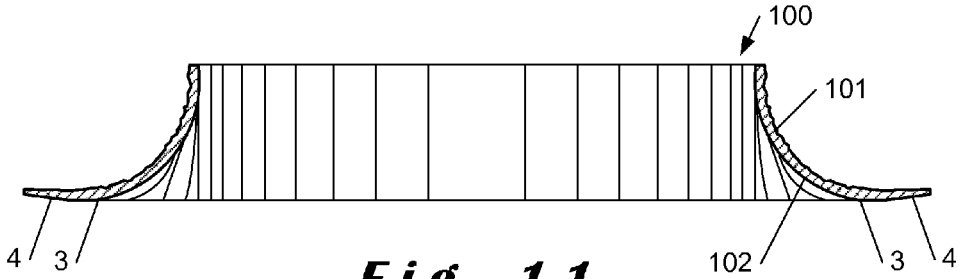
FIG. 11 shows a side-view of another embodiment of the construction element according to the invention.

FIG. 11 shows a curved, organically shaped construction element 100 which differs from the construction element 90 shown in FIG. 10 in that the body 101 comprises an opening leading to the volume created by the curved side walls 102. The construction element 100 can then be mounted to, for example, an opening in a wall (not shown) or a ceiling (not shown). The construction element 100 can for example be used for passing light through the opening left in the body 101, thus for example aesthetically finishing an opening to a roof, or window in the wall so that daylight can pass to the inside of the room. The exact shape, form and dimension can be chosen by the person skilled in the art depending on, for example, the function of the construction element 100.

Figure 12:
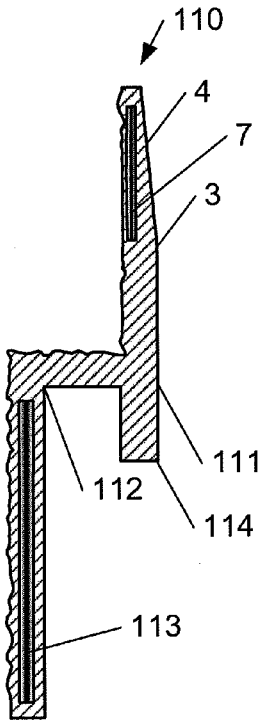
FIGS. 12, 13 and 14 show cross-sections of different embodiments of the construction element according to the invention comprising a corner section.

The construction element 110 shown in FIG. 12 differs from the construction element 1 shown in FIG. 1 in that the body 111 comprises two corner sections 112 and an additional reinforcing element 113. These differences were however previously discussed as possibilities in constructions elements shown in FIGS. 1-12.

The construction element 110 shown in FIG. 12 differs from the construction element 1 shown in FIG. 1 in that the body 111 comprises a protrusion 114 which protrudes from the surface of the body 111. The shape, form and function of the protruding part of the construction element 110 depends on the function of the protrusion. The protrusion can for example be used for mounting shelves or for receiving or creating a closet.

The construction element 110 shown in FIG. 12 can be used to for example cover walls (not shown) constituting a corner (not shown) so that an easy seamless and impact-proof connection of the plaster (not shown) covering the different walls creating the corner covered by the construction element 110 is created. The construction element 110 comprises two corner sections 112 but, alternatively, can also comprise less or more corner section 112 according to the desired aesthetical effect.

The corner section 112 shown in FIG. 12 can have any shape and form deemed appropriate by the person skilled in the art, such as for example rounded or straight.

Figure 13:
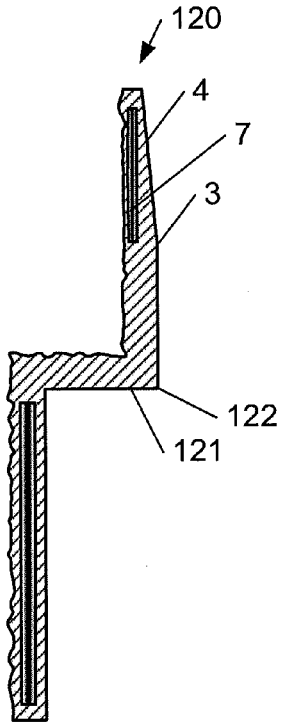

The construction element 120 shown in FIG. 13 differs from the construction element 110 shown in FIG. 12 in that it does not comprise a protrusion extending from the body 121.

Figure 14:
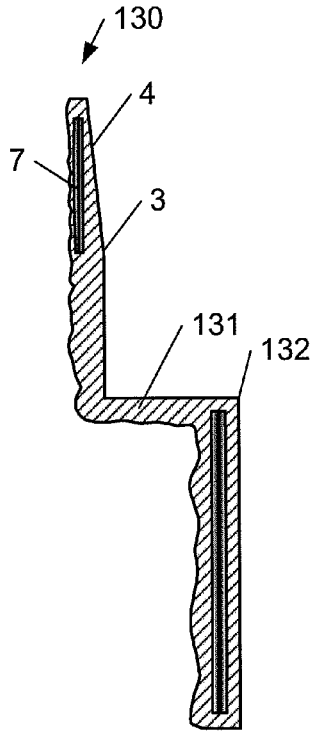

The construction element 130 shown in FIG. 14 differs from the construction element 120 shown in FIG. 13 in that the body 131 comprises a different shaped corner section 132 than the corner section 122 created in the construction element of FIG. 13.

The construction element 130 shown in FIG. 14 can also comprise a protrusion (not shown) as shown in FIG. 12.

The invention claimed is:

1. An interior decoration system comprising:

a wall plastering comprising a wall plastering material and covering a wall of a building construction; and a unit fixed to the wall of the building construction and comprising:

a body not covered by the wall plastering, the body having a functional, non-planar shape forming a volume configured to hold a secondary element, whereby the unit of the interior decoration system is provided with additional functionality; and wedge-shaped joining elements at peripheral edges of the body, wherein the wall plastering covers the wedge-shaped joining elements such that a top surface of the wall plastering is flush with the peripheral edges of the body and the unit is seamlessly integrated with the wall plastering, wherein the body and the wedge-shaped joining elements are constructed in a reinforced wall plastering material which has a predetermined composition with plaster as a substantial part, chosen such that the reinforced wall plastering material and the wall plastering material present around the body and covering the wedge-shaped joining elements comprise substantially the same substances and react in substantially the same way to temperature variations and humidity, wherein the unit further comprises at least one first reinforcing element, embedded in the reinforced wall plastering material of at least one of the wedge-shaped joining elements, which reinforces a connection of the unit to the building construction, and wherein the unit is fixed to the wall of the building construction by means of a fastener driven through the first reinforcing element and the corresponding one of the wedge-shaped joining elements into the wall of the building construction.

2. An interior decoration system according to claim 1, wherein the reinforced wall plastering material is glass reinforced gypsum.

3. An interior decoration system according to claim 1, wherein the wedge-shaped joining elements have a maximal thickness at the peripheral edge of the body, the maximal thickness being less than that of the wall plastering present around the peripheral edges.

4. An interior decoration system according to claim 1, wherein a second reinforcing element is embedded in the reinforced wall plastering material of the body at said volume, the secondary element being fixed to the second reinforcing element.

5. An interior decoration system according to claim 1, characterized in that at least one surface of the unit is curved.

6. An interior decoration system according to claim 1, wherein the unit is a light box.

7. An interior decoration system according to claim 6, wherein the volume is configured to hold a lamp.

8. An interior decoration system according to claim 1, wherein the unit is a doorjamb.

9. An interior decoration system according to claim 1, wherein the secondary element is of the following: a hinge, a receiver for a bolt of a door, a bracket for mounting a lamp, a lightsource, a loudspeaker, a curtain rail, an opening for air supply or extraction, a sprinkler, and a smoke detector.

10. An interior decoration system comprising:

a wall plastering comprising a wall plastering material and covering a wall of a building construction; and a unit fixed to the wall of the building construction and comprising:

a body not covered by the wall plastering, the body having a functional, non-planar shape; and wedge-shaped joining elements at peripheral edges of the body, wherein the wall plastering covers the wedge-shaped joining elements such that a top surface of the wall plastering is flush with the peripheral edges of the body and the unit is seamlessly integrated with the wall plastering, wherein the body and the wedge-shaped joining elements are constructed in a reinforced wall plastering material which has a predetermined composition with plaster as a substantial part, chosen such that the reinforced wall plastering material and the wall plastering material present around the body and covering the wedge-shaped joining elements comprise substantially the same substances and react in substantially the same way to temperature variations and humidity, wherein the unit further comprises at least one first reinforcing element, embedded in the reinforced wall plastering material of one of the wedge-shaped joining elements, which reinforces a connection of the unit to the building construction, and wherein a fastener is driven through the first reinforcing element and the corresponding one of the wedge-shaped joining elements into the wall of the building construction such that the wall plastering can cover the fastener.

11. An interior decoration system according to claim 10, wherein the reinforced wall plastering material is glass reinforced gypsum.

12. An interior decoration system according to claim 10, wherein the wedge-shaped joining elements have a maximal thickness at the peripheral edge of the body, the maximal thickness being less than that of the wall plastering present around the peripheral edges.

13. An interior decoration system according to claim 10, wherein the functional, non-planar shape forms a volume configured to hold a secondary element.

14. An interior decoration system according to claim 13, wherein a second reinforcing element is embedded in the reinforced wall plastering material of the body at said volume, the secondary element being fixed to the second reinforcing element.

15. An interior decoration system according to claim 13, wherein the secondary element is one of the following: a hinge, a receiver for a bolt of a door, a bracket for mounting a lamp, a lightsource, a loudspeaker, a curtain rail, an opening for air supply or extraction, a sprinkler, and a smoke detector.

16. An interior decoration system according to claim 10, wherein the unit is a doorjamb.

* * * * *